US007286090B1

(12) United States Patent
Rowell

(10) Patent No.: US 7,286,090 B1
(45) Date of Patent: Oct. 23, 2007

(54) MEANDER FEED STRUCTURE ANTENNA SYSTEMS AND METHODS

(75) Inventor: Corbett Rowell, Sha Tin (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 3 days.

(21) Appl. No.: 11/392,234

(22) Filed: Mar. 29, 2006

(51) Int. Cl.
*H01Q 1/24* (2006.01)

(52) U.S. Cl. ..... 343/702; 343/803

(58) Field of Classification Search ..... 343/700 MS, 343/702, 803, 905
See application file for complete search history.

(56) References Cited

U.S. PATENT DOCUMENTS

| | | | | |
|---|---|---|---|---|
| 4,860,020 | A | 8/1989 | Wong et al. | |
| 5,892,490 | A | 4/1999 | Asakura et al. | |
| 6,054,952 | A | 4/2000 | Shen et al. | |
| 6,861,986 | B2 | 3/2005 | Fang et al. | |
| 7,119,746 | B2 * | 10/2006 | Luk et al. | 343/702 |
| 7,132,999 | B2 * | 11/2006 | Yamagajo et al. | 343/895 |
| 7,205,954 | B2 * | 4/2007 | Yamagajo et al. | 343/803 |
| 2002/0175872 | A1 | 11/2002 | Apostolos | |
| 2003/0092420 | A1 | 5/2003 | Sugimoto et al. | |
| 2003/0098812 | A1 | 5/2003 | Zhinong et al. | |
| 2003/0193438 | A1 | 10/2003 | Yoon | |
| 2005/0062651 | A1 | 3/2005 | Kuo et al. | |
| 2006/0017621 | A1 * | 1/2006 | Okawara et al. | 343/700 MS |
| 2006/0077105 | A1 | 4/2006 | Jeong | |

FOREIGN PATENT DOCUMENTS

| | | |
|---|---|---|
| EP | 1 267 439 A1 | 5/2002 |
| EP | 1648050 | 4/2006 |
| GB | 2 370 419 A | 6/2002 |
| GB | 2 404 497 A | 2/2005 |
| GB | 2 413 900 A | 11/2005 |
| JP | 11205029 | 7/1999 |
| WO | WO 02/39540 A3 | 5/2002 |

OTHER PUBLICATIONS

International Search Report for PCT/CN2007/000773 dated Jun. 28, 2007, 3 pgs.

* cited by examiner

*Primary Examiner*—Tan Ho
(74) *Attorney, Agent, or Firm*—Fulbright & Jaworski LLP

(57) ABSTRACT

A transmitting and receiving system including an antenna element having first and second current paths, and a meander feed line connected to said first and second current paths, the meander feed line including a radiating portion parallel to the first current path, wherein a current in the radiating portion is in a direction opposite of a current in the first current path, and wherein a current in the second current path is in a direction the same as the current in said radiating portion.

22 Claims, 4 Drawing Sheets

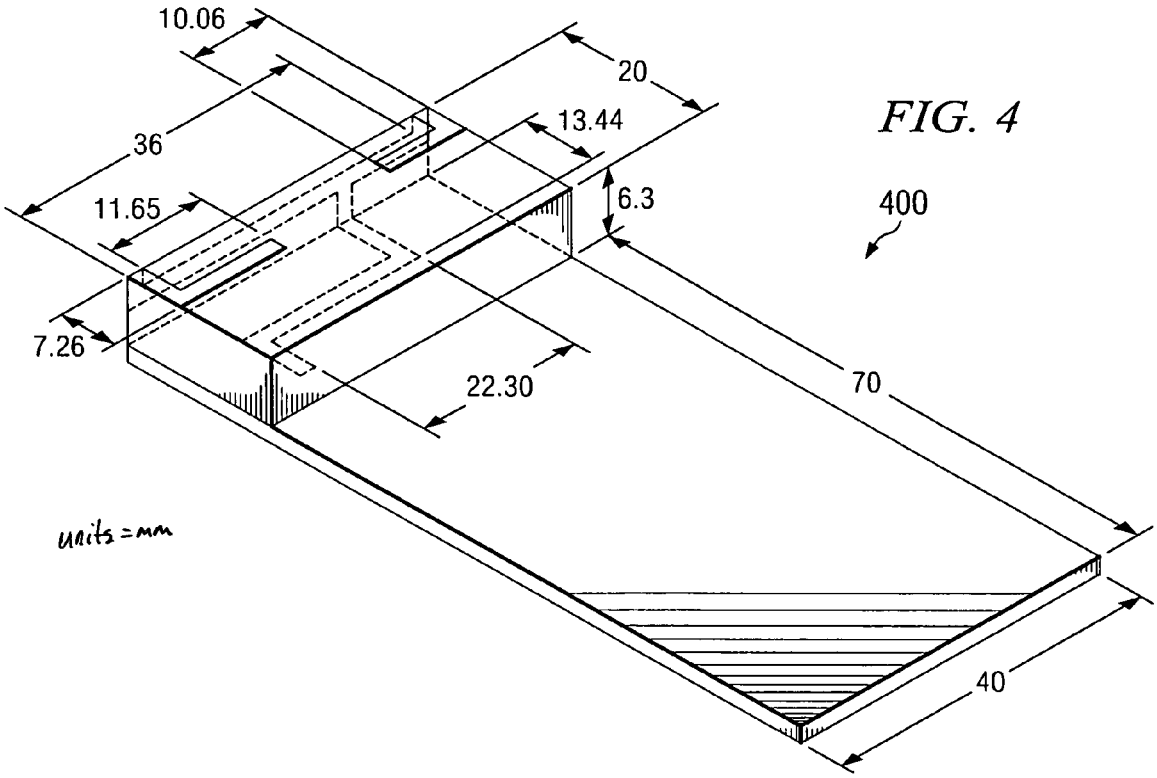
FIG. 4
FIG. 5
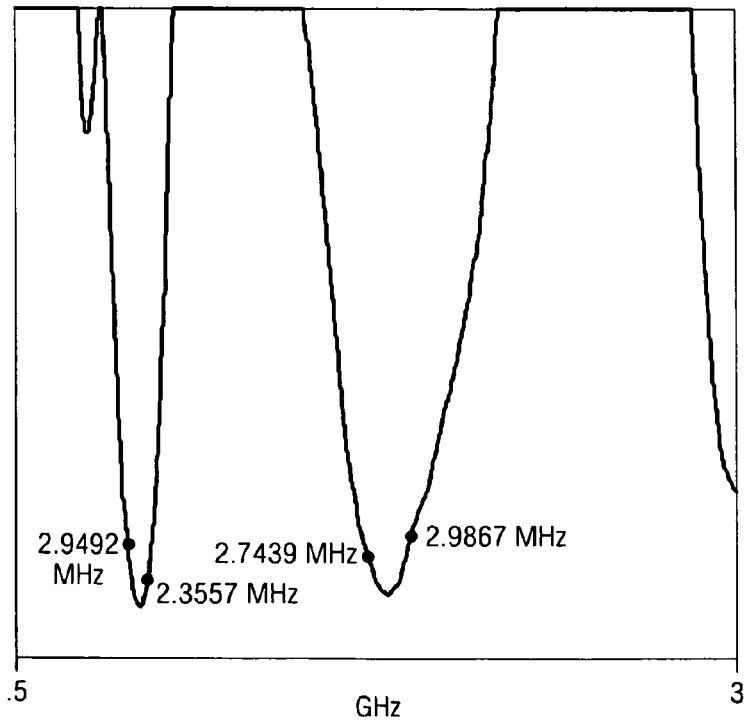

MEANDER FEED STRUCTURE ANTENNA SYSTEMS AND METHODS

TECHNICAL FIELD

Various embodiments of the present invention relate in general to antenna systems and methods of operation thereof, and more specifically to multi-band antenna systems with meander feed structures and methods of operation thereof.

BACKGROUND OF THE INVENTION

Many wireless devices include antennas that are printed or mounted on Printed Circuit Boards (PCBs) with other circuits. During operation, currents in an antenna may couple with currents in wires on the PCB. Coupling is a phenomenon that is known to designers of electromagnetic devices, and it involves both capacitive and inductive effects and includes the transfer of electromagnetic energy between one current and the other current.

Coupling is illustrated in FIGS. 8A-C. The greatest amount of coupling occurs with parallel currents, as in FIGS. 8A and 8C. If the currents are in opposite directions, the current generally cancel, at least partially, if the spacing between the conductors is within approximately one-sixteenth of a wavelength. On the other hand, currents in the same direction will generally add when spaced within approximately one-sixteenth of a wavelength. The least amount of coupling generally occurs with perpendicular currents, as in FIG. 8B.

As explained above, when two currents are coupled, the two affect each other additively or subtractively, and a change in one will usually cause a change in the other. Thus, when a radiating structure has a current that is coupled to a second current, a change in the second current can affect the radiation performance of the radiating structure. In other cases, especially when a PCB includes materials that readily absorb Radio Frequency (RF) energy and turn it into heat, such coupling can further lower total system performance. Coupling is generally seen by designers as a problem or something to be worked around. However, it is difficult to eliminate all coupling.

BRIEF SUMMARY OF THE INVENTION

Various embodiments of the present invention are directed to systems and methods which include a meander feed connecting an antenna element to a signal source. For example, a meander feed has at least one radiating portion that is arranged to be parallel and opposite in direction to a first current path in the antenna element. Thus, when current flows through the meander feed and the first current path in the antenna element, the current in the first current path is at least partially canceled by coupling with the current in the radiating portion of the meander feed.

In addition to the first current path, various embodiments include a second current path that is parallel to the first current path and the radiating portion of the meander feed and in a direction the same as the radiating portion. Thus, when current flows through the meander feed and the second current path, the currents add through coupling.

In this example, the at least partial canceling of the current in the first current path may allow the resonant frequency of the first current path to be tuned effectively independently from the resonant frequency of the second current path. Further, the radiating portion of the meander feed may be used by the antenna system to add a resonant frequency to its spectrum of operating bands or it may be tuned to match the resonant frequency of the second current path, thereby increasing the bandwidth of the resonance of the second current path. Accordingly, various embodiments couple the antenna element to the meander feed so that the meander feed itself acts as a radiator and enhances total system performance. Thus, various embodiments of the present invention may be used to create or improve multi-band antenna systems and method for operation thereof.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 4 is an illustration of an exemplary antenna system according to one embodiment of the invention;

FIG. 5 is a graph of a frequency response associated with an exemplary system;

DETAILED DESCRIPTION OF THE INVENTION

Figure 1A:
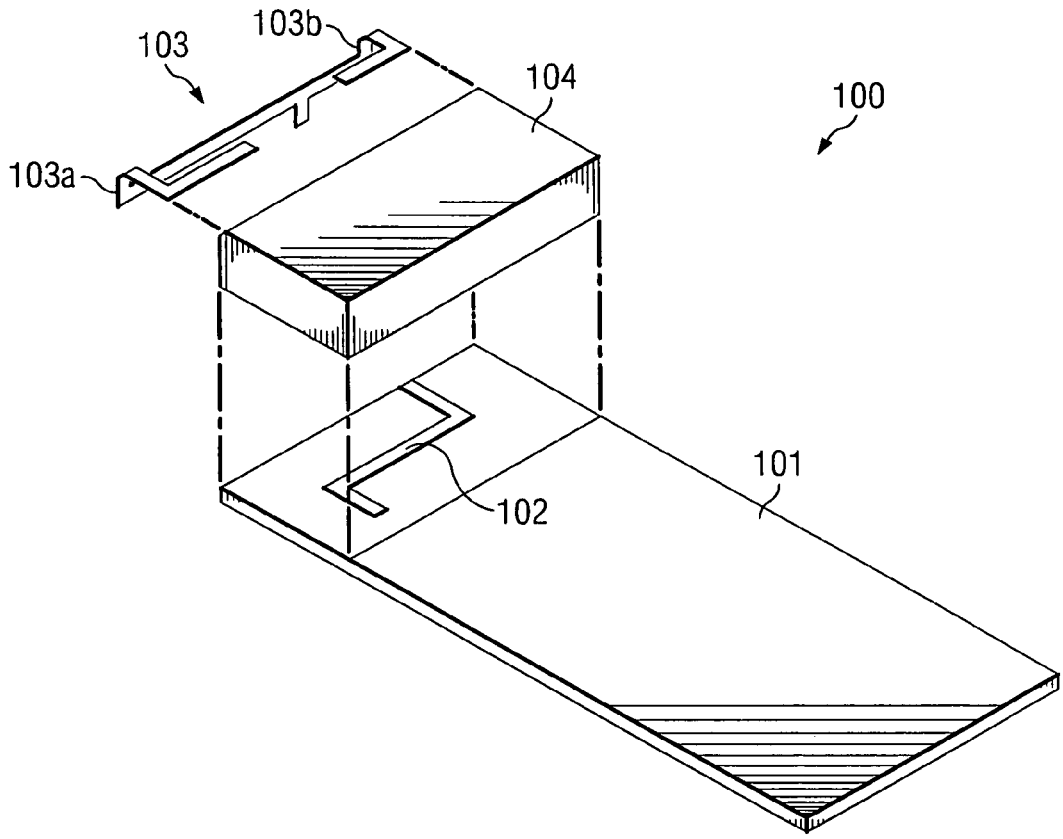
FIGS. 1A through 1C are exploded views of an exemplary antenna system adapted according to one embodiment of the present invention.
Figure 1B:
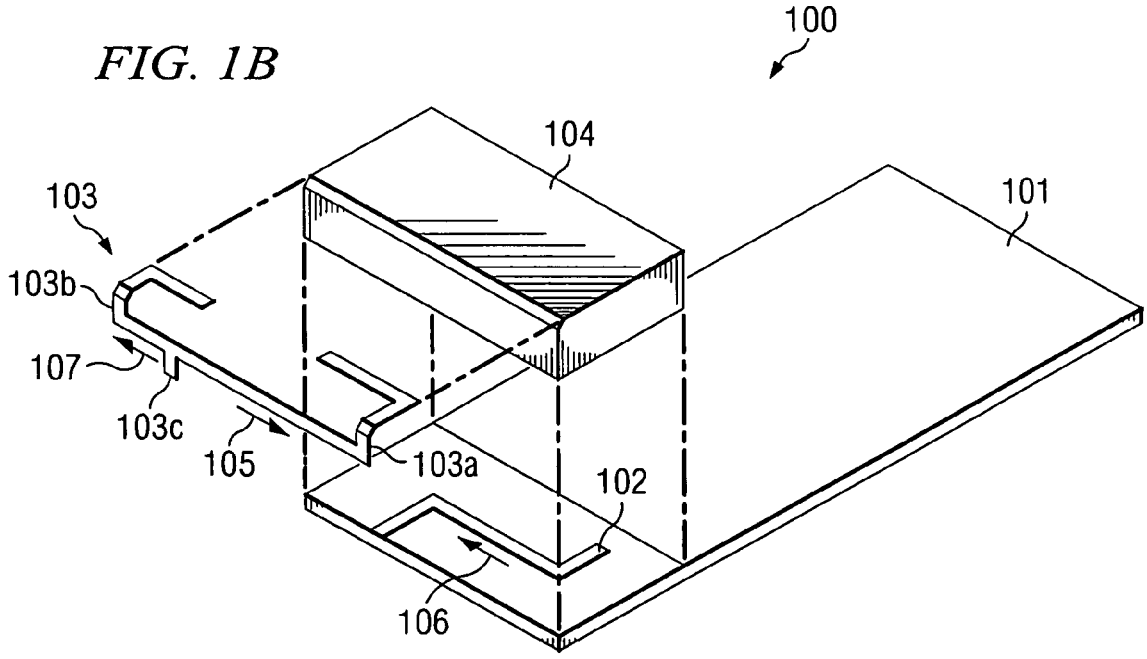
Figure 1C:
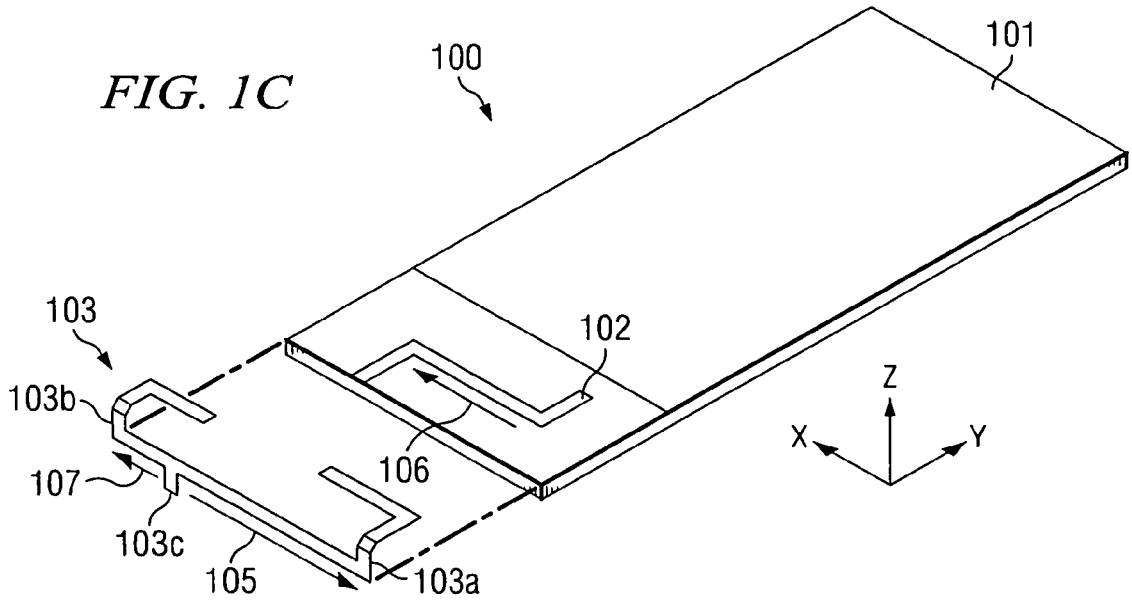

FIGS. 1A-1C are exploded views of exemplary antenna system 100 adapted according to one embodiment of the present invention. Antenna system 100 includes meander feed structure 102. Meander feed structure 102 provides a conducting path from one feed point to another feed point, such as in system 100, a feed point from Printed Circuit Board (PCB) 101 to feed point 103*c* of antenna element 103. Meander feed structure 102 allows a placement of feed point 103*c* to be at least somewhat independent of a placement of the feed point on PCB 101. Also, as explained further below, the placement of meander feed structure 102 affects the resonant frequencies of antenna system 100 and the coupling between the currents responsible for those resonant frequencies.

Antenna system 100 also includes antenna element 103, which is connected to meander feed structure 102 by feed point 103*c*. In this example, antenna element 103 is a "U-shaped" element that is three-dimensional and ungrounded. In this example, current paths 103*b* and 103*c* are parallel to the middle portion (radiating portion) of meander feed structure 102. The particular shape of antenna element 103 in this example has the quality that current 105 of current path 103*a* for frequency flows in the opposite direction of current 106 of meander feed 102, thereby decoupling current 105 from current 107 so that the frequency resonance of current path 103*b* can be independently tuned with respect to the frequency resonance of current path 103*a*. Such a feature facilitates a multi-band or dual-band antenna system in a small design, as explained further below. Block 104 in this example is a support block for antenna element 103 and may be made from any of a variety of materials that have a minimal effect on the radiation performance of antenna system 100. Block 104 is not depicted in FIG. 1C for convenience.

Meander feed structure 102 is placed or printed, in this example, on PCB 101. Meander feed structure 102 is a staircase shape in this example in order to be parallel to current paths 103*a* and 103*b*.

It should be noted that various embodiments of the invention may be employed in wireless devices, such as mobile phones, Personal Digital Assistants (PDAs), mobile email devices (e.g., a BLACKBERRY™, available from Research in Motion Limited), and the like. In such applications, it is common for an antenna device to receive signals from a PCB. However, circuit designers may design the PCB without optimization in mind for the antenna structure, especially with regard to placement of feeds. Meander feeds, such as feed 102, allow antenna designers to route a signal from a location on a PCB to a more ideal location to feed into one or more antenna elements. In this example, meander feed structure 102 carries signals from a location on PCB 101 where device designers placed a feed to feed point 103*c* on antenna element 103.

Various factors play a role in placing antenna feeds. For instance, feeding location can change impedance matching requirements, requiring more or fewer matching components and affecting bandwidth. Also, feed location can change electric and magnetic field distributions and effect how an antenna couples to other nearby components. Still further, for ungrounded antennas elements (e.g., element 103), the feed location can shift the frequency resonances. In the example of FIG. 1C, a feed location toward the y-axis edge of PCB 101 would generally tend to decrease bandwidth due to increased coupling with other electronic components (e.g., various components not shown, such as a camera, speakers, an RF module, a battery, and the like), but radiation performance would generally be increased. Conversely, moving the feed location away from the edge of PCB 101 along the y-axis would tend to increase bandwidth while decreasing radiation performance. Moving the feed location along the x-axis may change resonant frequencies and shift radiation patterns.

Figure 2:
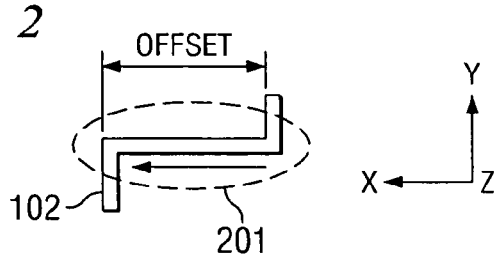
FIG. 2 is an illustration of an exemplary meander feed structure adapted according to one embodiment of the invention.

In the embodiment of system 100, feed point 103*c* is placed at the end of PCB 101 along the y-axis in order to take advantage of increased radiation performance. Meander feed structure 102 allows a designer of antenna system 100 to place feed point 103*c* at a desired x-y location on PCB 101, regardless of the placement of the feed by a PCB designer. FIG. 2 is an illustration of meander feed structure 102 adapted according to one embodiment of the invention. Meander feed structure 102 may be referred to as an "offset feed structure" because of its x-axis offset. Portion 201 is parallel to current paths 103*a* and 103*b*, and is referred to below sometimes as the "radiating portion" of meander feed structure 102.

The staircase shape of meander feed structure 102 has additional benefits. For instance, in various embodiments of the invention, by varying the distance of current paths 105 and 107 (e.g., FIG. 1C) from current path 106 a designer can control the amount of coupling that occurs between radiating portion 201 and antenna structure 103. Closer distances between antenna structure 103 and radiating portion 201 leads to more coupling; a greater distance leads to less coupling.

Returning to FIG. 1C, antenna element 103 is a U-shaped antenna; however, antenna element 103 may be any three-dimensional antenna that allows radiating portion 201 (FIG. 2) of feed line 102 to radiate outward. Further, while antenna element 103 includes two current paths 103*a* and 103*b*, other embodiments may be adapted to include more than two current paths. For example one embodiment may include three or four current paths, and the principles of operation are roughly the same as in the example of FIGS. 1A-C.

Figure 3:
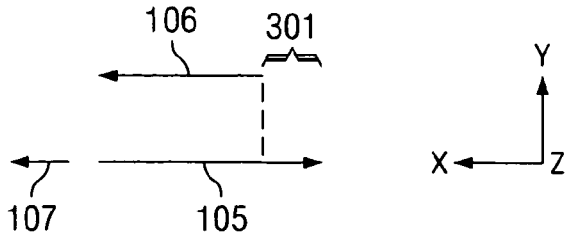
FIG. 3 is an illustration of exemplary currents adapted according to at least one embodiment of the invention.

FIG. 3 is an illustration of exemplary currents 105-107 adapted according to at least one embodiment of the invention. In this example, current 105 is partially canceling with feed current 106 because the currents are in opposite directions. Thus, portion 301 is the principal radiating section of current path 103*a* (e.g., FIG. 1C), although the resonant frequency is determined, at least in part, by the entire length of path 103*a*. The partial canceling also means that the resonant frequency of current path 103*a* can be tuned substantially independently of the frequency resonance of current path 103*b* (e.g., FIG. 1C) because the currents in current paths 103*a* and 103*b* are effectively decoupled. "Substantially independently" in this context means that the frequency can be tuned within 5-10% without affecting the radiation performance or bandwidth of current path 103*b*. As for current path 103*b* and current 107, because current 107 is in the same direction as feed current 106, there is an additive coupling between the two.

This phenomenon can be used to increase the bandwidth of antenna element 103 that is attributable to current path 103*b* by tuning the resonance of radiating portion 201 (FIG. 2) so that it substantially matches (i.e., the resonant frequencies are within 5-15% of each other) the resonance of current path 103*b*, thereby increasing the bandwidth of current path 103*b* to possibly include the entirety of an established communication band or even an additional established communication band. For instance, in one example, current path 103*b* is operable to provide radiation performance in the Global System for Mobile Communications (GSM) 1800 communication band (~1.710 GHz-1.785 GHz and 1.805 GHz-1.880 GHz). However, by properly tuning the radiating portion of meander feed line 102 and/or current path 103*b*, performance can be improved to also include GSM 1900

(~1.850 GHz-1.910 GHz and 1.930 GHz-1.990 GHz), thereby providing dual-band coverage. Alternatively, the resonant frequency of current path 201 can be used as an additional resonant frequency for the antenna system by not matching the frequencies of current paths 103*b* and 201.

FIG. 4 is an illustration of exemplary system 400 adapted according to one embodiment of the invention. System 400 is similar to system 100 (FIG. 1) and provides dimensions for the various components. System 400 can be employed in a system that is operable to communicate in the GSM 900 (~890 MHz-915 MHz and 935 MHz-960 MHz) and GSM 1800 bands. In fact, system 400 can be included in a package that has a total volume of 37 mm by 65 mm by 5 mm, electromagnetic shielding (not shown) for the PCB included. FIG. 5 is a graph of a frequency response associated with system 400 showing performance in the GSM 900 and 1800 bands.

Figure 6A:
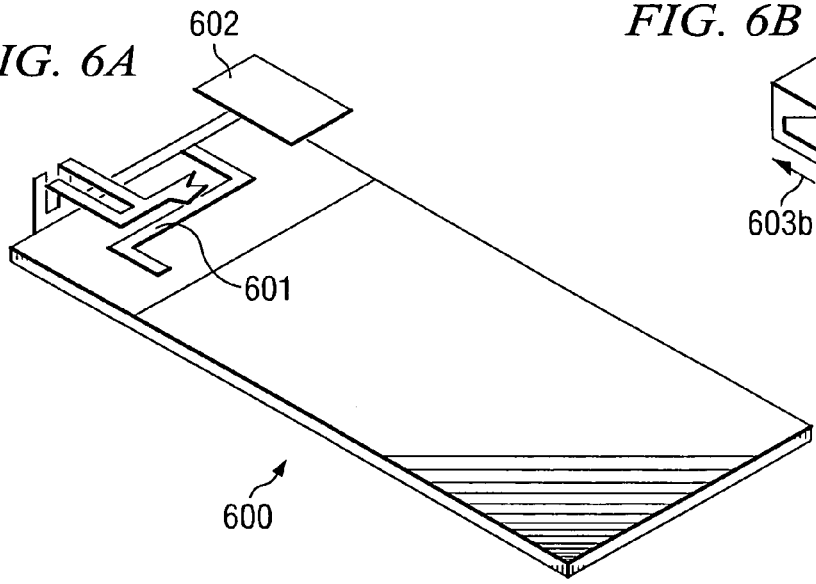
FIG. 6A is an illustration of an exemplary system adapted according to one embodiment of the invention.
Figure 6B:
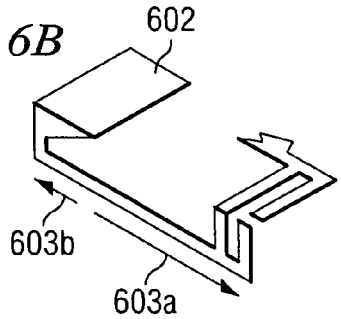
FIG. 6B is an illustration of an exemplary antenna element employed in the system of FIG. 6A.

While the examples above illustrate an embodiment that employs a U-shaped Planar Inverted-F Antenna (PIFA)/monopole design, other kinds of designs can be used by various embodiments of the invention. FIG. 6A is an illustration of exemplary antenna system 600 according to one embodiment of the invention, and FIG. 6B is an illustration of antenna element 602 employed in system 600. System 600 includes, among other things, offset meander line feed 601 and three-dimensional antenna element 602. Antenna element 602 is a modified U-shaped PIFA/monopole design with multiple slots, and it includes current paths 603*a* and 603*b*. While the design of antenna element 602 looks different from the U-shaped design of system 100 (FIG. 1), system 600 takes advantage of coupling phenomena between feed line 601 and current paths 603*a* and 603*b* as in the examples above.

Figure 7:
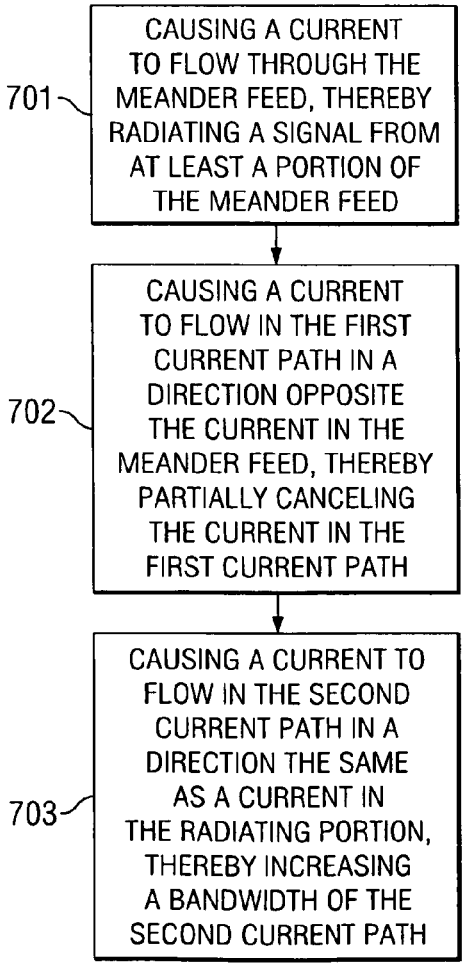
FIG. 7 is an illustration of an exemplary method adapted according to one embodiment of the invention that may be performed by a user of an antenna system.
Figure 8A:
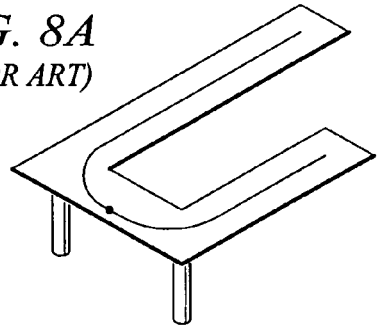
FIG. 8A (PRIOR ART)
FIGS. 8A-C are illustrations of coupling among various currents.
Figure 8B:
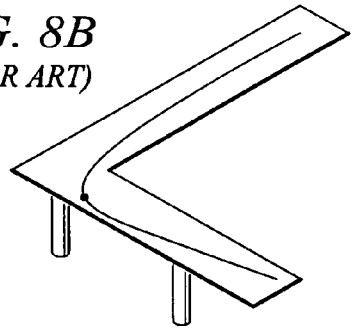
FIG. 8B (PRIOR ART)
Figure 8C:
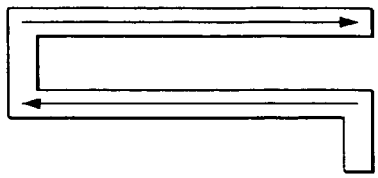
FIG. 8C (PRIOR ART)

FIG. 7 is an illustration of exemplary method 700 adapted according to one embodiment of the invention that may be performed by a user of an antenna system, the antenna system including a meander feed with a radiating portion and first and second current paths fed by the meander feed, wherein the first and second current paths are parallel to the radiating portion. Examples of one such antenna systems include system 100 of FIGS. 1A-C and system 600 of FIG. 6A. In step 701, a current is caused to flow though the meander feed, thereby radiating a signal from at least a portion of the meander feed. In step 702, a current is caused to flow in the first current path in a direction opposite the current in the meander feed, thereby partially canceling the current in the first current path. In step 703, a current is caused to flow in the second current path in a direction the same as a current in the radiating portion, thereby increasing a bandwidth of the second current path. Step 703 may be accomplished, in one example, by tuning the second current path so that its resonant frequency substantially matches a resonant frequency of the radiating portion of the meander feed. Alternatively, step 703 may include radiating at least one band from the second current path and at least one other band from the radiating portion of the meander feed without increasing the bandwidth attributable to the second current path. Although 701-703 are referred to as "steps," there is no requirement that the y be performed sequentially. In fact, 701-703 may be performed simultaneously.

In traditional antenna systems that use meander feeds, it is often true that the meander feed is much smaller than a wavelength and is not creating a resonance that radiates outward. In fact, meander feeds are often used as an impedance matching component to match the antenna to its signal feed. In embodiments of the present invention, the impedance matching function can be accomplished through use of an inductor in series between the feed of the PCB and the feed of the antenna if the impedance matching provided by the meander is not sufficient.

Other traditional systems may use the meander as the antenna itself. For example, some systems may make a feed wire into a helix type antenna. However, such antennas tend to be only single-band structures because it can be quite difficult to create a multi-band meander feed antenna element due to, among other things, negative coupling to signals on the PCB. Thus, pure meander antennas are not generally used inside mobile phones or other wireless devices.

Another use of meanders in traditional systems has been as capacitive meander feeds, or parasitic elements. A capacitive meander feed can be generally described as a meandering feed that is strongly coupled to an antenna element such that the antenna radiates outward, but the meander does not radiate outward. In contrast, various embodiments of the present invention allow the radiating portion of the meander to radiate outward.

Various embodiments of the invention may include one or more advantages over traditional systems. For instance, as explained above, the meander feed may allow antenna designers to place the antenna feed location independently of a PCB feed location. Also, in some embodiments it is possible to control and use the coupling between the antenna system and the meander feed line to increase bandwidth of the antenna element or to create an additional resonant frequency. Still further, decoupling one or more resonant frequencies also allows easier tuning for an antenna system. Thus, by using such design it may be possible and desirable to decrease the distance between the antenna and the PCB, thereby making the entire device size smaller.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A transmitting and receiving system comprising:

an antenna element having first and second current paths; and a meander feed line connected to said first and second current paths, said meander feed line including a radiating portion parallel to said first current path, wherein a current in said radiating portion is in a direction opposite of a current in said first current path, and wherein a current in said second current path is in a direction the same as said current in said radiating portion.

2. The system of claim 1 wherein a resonant frequency of said second current path is tuned so that the radiating portion causes a bandwidth increase in said second current path.

3. The system of claim 1 wherein said antenna element is a three-dimensional U-shape with a feed location at a bottom of said U-shape, and wherein branches of said U-shape are said first and second current paths.

4. The system of claim 1 wherein said radiating portion and said second current path are spaced to be in electromagnetic communication with each other, thereby decoupling said current in said first current path from said current in said second current path, such that a resonance of said first current path is independently tunable from a resonance of said second current path.

5. The system of claim 1 wherein said antenna element is ungrounded.

6. The system of claim 5 wherein said first and second current paths are monopole structures.

7. The system of claim 1 wherein said meander feed line is a conductor on a Printed Circuit Board (PCB), said PCB providing a ground plane.

8. The system of claim 7 wherein said system is disposed in a wireless handset.

9. The system of claim 8 wherein said system is included in a Planar Inverted-F Antenna (PIFA) apparatus, said PIFA apparatus including a plurality of connections to said PCB ground plane.

10. The system of claim 7 wherein a feed point on said antenna is offset in at least one dimension from a feed point on said PCB, and wherein said offset in said at least one dimension defines said radiating portion of said meander feed line.

11. A method performed in an antenna structure, said antenna structure including:

a meander feed with a radiating portion, first and second current paths fed by said meander feed, wherein said first current path is parallel to said radiating portion, the method comprising:

causing a current to flow though said meander feed, thereby radiating a signal from said radiating portion of said meander feed;

causing a current to flow in said first current path in a direction opposite said current in said radiating portion of meander feed, thereby partially canceling said current in said first current path; and causing a current to flow in said second current path in a direction the same as said current in said radiating portion of meander feed, thereby additively coupling said current in said second current path and said current in said radiating portion of meander feed.

12. The method of claim 11 further comprising:

tuning said second current path so that its resonance substantially matches a resonance of said radiating portion of meander feed, thereby increasing a bandwidth of said resonance of said second current path.

13. The method of claim 11 further comprising radiating separate bands from each of said first and second current paths and said radiating portion of meander feed.

14. The method of claim 11 wherein said first and second current paths are included in an ungrounded antenna element.

15. The method of claim 14 wherein said first and second current paths are included an antenna element arranged in a three-dimensional U-shape with a feed location at a bottom of said U-shape, and wherein branches of said U-shape are said first and second current paths.

16. An antenna system comprising:

a meander line connecting an antenna element to a signal source, said antenna element including first and second current paths parallel to a radiating portion of said meander line, said first current path in a direction opposite a direction of said radiating portion, said second current path in a same direction as said radiating portion;

a current in said first current path;

a current in said second current path; and a current in said meander line provided to said antenna element, wherein said first and second current paths and said radiating portion of said meander line are spaced such that coupling occurs between said current in said first current path and said current in said meander line and between said current in said second current path and said current in said meander line.

17. The system of claim 16 wherein said currents are in the frequency range of 700 MHz to 1.99 GHz.

18. The system of claim 16 wherein said antenna element is a three-dimensional U-shape with a feed location at a bottom of said U-shape, and wherein branches of said U-shape are said first and second current paths.

19. The system of claim 16 wherein said coupling between said current in said first current path and said current in said meander line causes at least partial cancellation of said current in said first current path.

20. The system of claim 16 wherein said coupling between said current in said second current path and said current in said meander line is additive coupling.

21. The system of claim 16 wherein said meander line is a conductor on a Printed Circuit Board (PCB).

22. The system of claim 16 wherein a feed point on said antenna element is offset in at least one dimension from a feed point on said PCB, and wherein said offset in said at least one dimension defines said radiating portion of said meander line.

* * * * *